United States Patent [19]

Dameron, Jr. et al.

[11] 4,210,012

[45] Jul. 1, 1980

[54] ROLL COMPACTING OF STRANDED CONDUCTOR

[75] Inventors: H. Clifford Dameron, Jr.; Guy E. Martin, both of Ross Township, Allegheny County; Nicholaas L. Brouwer, Washington Township, Fayette County, all of Pa.

[73] Assignee: Aluminum Company of America, Pittsburgh, Pa.

[21] Appl. No.: 13,307

[22] Filed: Feb. 21, 1979

[51] Int. Cl.[2] ..... H01B 13/00; B21B 1/18

[52] U.S. Cl. ..... 72/235; 72/366; 72/65

[58] Field of Search ..... 57/9, 311; 140/149, 140/92.93; 72/235, 234, 199, 366; 29/624

[56] References Cited

U.S. PATENT DOCUMENTS

| | | | |
|---|---|---|---|
| 2,821,727 | 2/1958 | Corchran | 72/235 X |
| 3,756,059 | 9/1973 | Kraft et al. | 72/235 |
| 4,079,510 | 3/1978 | McGrath et al. | 29/624 |

*Primary Examiner*—Milton S. Mehr
*Attorney, Agent, or Firm*—Elroy Strickland

[57] ABSTRACT

An apparatus for making compacted, helically stranded cable having a circular configuration in cross-section. The apparatus comprises a first set of opposed rollers each having a peripheral concave edge and surface such that when the edges of the rollers are placed together, the concave surfaces provide an opening having a major and a minor axis located perpendicular to each other across the cross-section of the opening. A second set of opposed rollers having peripheral concave surfaces provides a second opening, the second set of rollers and opening being located downstream from the first set of rollers and in line with the first opening. The concave surfaces of the second opening have a relief along an axis that is rotated approximately 90° from the major axis of the first opening. Stranded cable is compacted by the two sets of rollers in a manner that provides the cable with a circular cross-section and residual stress pattern that is substantially uniform and generally symmetrical throughout the cross-section of the cable.

2 Claims, 6 Drawing Figures

ROLL COMPACTING OF STRANDED CONDUCTOR

BACKGROUND OF THE INVENTION

The present invention relates generally to the compacting of outer helical strands on a core having a relatively fixed diameter, and particularly to the compacting of cable or conductor in a manner that affords a number of advantages not presently available with the present state of the art.

Generally, apparatus employed to compact a stranded cable, i.e., a cable comprised of a plurality of individual wire strands, employs a solid stationary die to force an outer layer of the strands together on a core and into a compact cable structure in cross-section, as the cable and core are pulled through the die. More specifically, if a conductor comprised of seven strands is desired, six outer strands are compacted on a single wire, which wire comprises the core of the conductor, as the core wire and six outer strands are pulled through an appropriately sized die. If a nineteen-strand conductor is desired, the above seven-strand compacted conductor is employed as the core, and twelve outside strands are compacted on the seven strands, again with an appropriately sized die. In other words, whatever size (in diameter) cable is needed, each outside layer of strands is pulled throuh a die, with an appropriate core, and thereby compacted on the core. And each outside layer of strands enters the die from a rotating carriage carrying a corresponding plurality of spools of the wire strands, the rotating carriage causing the plurality of such strands to twist or rotate as they enter and pass through the die. It can be appreciated that lubrication of the annular, compacting surface of the die and the surfaces of the outer strands, which are in contact with the fixed die surface, is critical in such a process.

In addition, strands that are soft or annealed are difficult to compact in solid stationary dies, even with proper lubricants, as the metal of strands galls and chafes on the die surface. With hard, as-drawn wire, galling is not a substantial problem. In either case, when compacting with a die, pulling forces are exerted on the strands and the wire changes cross-sectional configuration and elongates. The metal, as it is being worked by the die, flows plastically and heat is generated from the cold work and friction between the fixed surface of the die and the outer strands. In such a state the strands are more susceptible to breakage by short duration, high tensile stress. Consequently, the softer or more annealed the strands are, or the smaller in diameter the strands are, the slower the speed must be to reduce wire breakage, yet the forces required to pull the cable through the dies remain substantial because of the fact that the die surfaces are fixed.

Another problem associated with stationary dies is the tendency of wire shapes that are other than round, such as trapezoidal, to rotate individually about their axes as they are pulled through the dies. Such a tendency locates the individual strands in the completed cable in a tilted or cocked manner such that the effective diameter of the cable is increased and the cross-section of the cable is not solidly packed.

Further, because of the friction and forces between the strands and fixed dies employed for cable compacting, a substantial amount of working of the strands takes place. If the metal of the strands is soft, the strands leaving the dies are work-hardened. If the strands to be compacted are already work-hardened, which occurs when the strands are drawn, the hardness of such strands is increased by the cold work encountered in compacting in fixed dies. In cases where stranded cables are produced for end uses in which workmen must be able to bend and otherwise manipulate the cable, such as with building wire, the strands of the cable should be soft. This requires a minimum of working in the stranding and compacting process.

U.S. Pat. No. 1,947,775 to Hill discloses the use of opposed rollers that provide a die opening employed to form a pre-spiralled non-circular (i.e., triangular) stranded conductor for a cable comprised of a plurality of such conductors. The rollers are rotated about the longitudinal axis of the conductor in the forming process, and the rollers are driven, along with a capstan positioned to pull the conductor through the rollers and opening, the power of the driving action being divided between the capstan and rollers to control tension on the conductor and thereby avoid stretching of the conductor in the rolling process.

A similar structure and process are disclosed in U.S. Pat. No. 2,128,777 to Hunter et al, except that two consecutive roller dies are employed to form a non-circular, sector or triangular shaped opening and conductor, the two roller dies again being operative to rotate or revolve about the axis of the conductor in the conductor forming process.

While the apparatus of these two patents reduces work-hardening and plastic flow problems associated with stationary dies, the rollers of the apparatus do not compact outer strands on a conductor core having a relatively fixed diameter, and in such a manner that insures that the stress pattern of the cable will be uniform through the cross-section of the cable. Rather, the function of the roller dies of Hill and Hunter et al is to form a spiralling, triangular or sector shaped conductor which requires revolving the rollers about the axis of the conductor, and driving the rollers in order to control tension on the conductor. The sectors are then placed together to form a composite cable.

In U.S. Pat. No. 1,979,013 to Rohs there is disclosed the use of rollers to preform individual wires with a twist that is shorter than the pitch required for the cable produced from the wires, see column 1, lines 31 to 38 and lines 49 to 54 of the patent. And like Hill and Hunter et al, the Rohs rollers are revolved about the axis of the wire conductor to form the pitch of the conductor.

BRIEF SUMMARY OF THE INVENTION

The present invention is directed to an apparatus and method for producing a circular stranded cable or conductor (in cross-section) in a manner that requires minimal lubrication, reduces substantially the force and electrical power required to pull the cable through the apparatus, results in minimal work-hardening of the strands in the process of forming the cable, provides a way to compact wire that has been annealed, and increases substantially the speed at which the cable can be produced. As yet, there is no limit on the speed at which the cable can be formed and produced using the principles of the invention.

These and other advantages are effected by the use of aligned roller assemblies, with each assembly comprised of opposed rollers having peripheral concave surfaces that form a generally circular opening. The opening of the first assembly has a major and a minor axis located perpendicular to each other in the cross-section of the opening, while the opening of the second die is a perfect circle except for opposed reliefs along an axis located in the plane of the minor axis of the first opening. When wire strands are directed onto a solid or compacted core entering the first opening, as the core and strands are pulled through the opening, the strands engage the concave surfaces of the rollers which rotates the rollers as the cable passes between the rollers. The outer strands are compacted on the core by the concave surfaces of the first set of rollers in a non-uniform manner, i.e., in a manner that effects the greatest amount of compacting in the direction of the minor axis of the opening, the amount of compacting decreasing in the direction of the major axis; at and adjacent the immediate vicinity of the major axis the strands will tend to remain uncompacted.

The strands leaving the first set of rollers enter the second set in a manner that completes the compacting of the outer strands, the orientation of the second set of rollers being such that the strands that are not compacted in the first set of rollers are compacted in the second set.

Such a compacting process provides a circular cable in cross-section having a residual stress pattern that is substantially uniform and symmetrical throughout the cross-section of the cable. Because the stress pattern in the cable leaving the apparatus of the invention is substantially uniform, the cable does not go out of tolerance or birdcage when stresses in the cable are relieved. Relief of stress occurs when the metal of the cable is annealed or when the cable is insulated, the insulating process taking place at elevated temperatures. Birdcaging is particularly troublesome when a cable is to be insulated. Birdcaging, as the name implies, is a phenomenon involving outward movement and separation of the strands from each other, as they seek an even, uniform stress pattern, thereby leaving open spaces between the strands. In applying an insulating layer to the cable, the material of the layer tends to enter and sink into the spaces between the strands, which leaves the outer strands with minimal or no insulation.

In addition, the forming process of the invention provides a cable that is fully compacted, without under or over-filling, or twisting of the strands in the case of shapes other than circular, such that there is good economical use of the metal of the cable, i.e., there is less open, wasted space within the cable, thereby providing a cable having a minimum outside diameter without a corresponding decrease in its current carrying capabilities.

THE DRAWINGS

The invention, along with its advantages and objectives, will be best understood from consideration of the following detailed description and the accompanying drawings in which.

PREFERRED EMBODIMENT OF THE INVENTION

Figure 1:
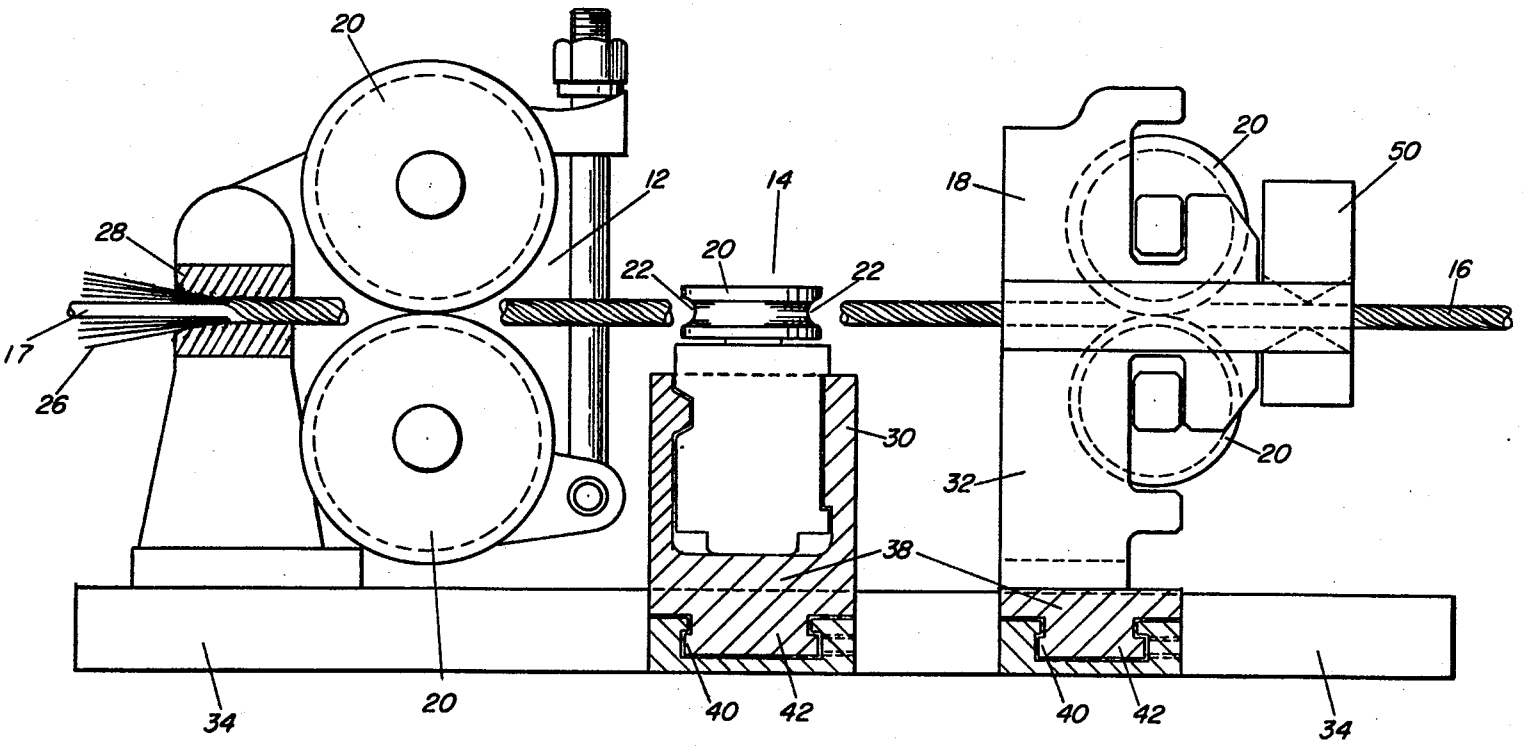
FIG. 1 is a side elevation view of compacting roller sets and stands of the apparatus of the invention.

Referring now to FIG. 1 of the drawings, the apparatus of the invention, generally labeled 10, comprises at least two roller assemblies 12 and 14 adapted to compact the outer strands of a stranded cable 16 on an inner core 17 when the cable is directed between the rollers 20 of the assemblies. A third roller assembly 18 may be employed to effect further rounding of the cable exiting from 14 if further rounding is necessary.

Each roller assembly (12, 14 and 18) comprises a set of two rollers 20 with each roller having an outwardly facing, concave, peripheral edge and surface 22 (FIGS. 3 through 6). The two rollers (of each set and assembly) are disposed opposite each other and are brought together at a location on the periphery of each roller when the two rollers are positioned for compacting a cable, such as 16. The peripheral concave surfaces of each set of rollers form a generally circular opening 24 at the location at which the rollers are brought together. Each roller 20 is mounted for rotation on a suitable, centrally located bearing arrangement not visible in the drawings.

As shown in FIG. 1 of the drawings, a plurality of wire strands 26 first enter a stationary gathering die 28 before they enter opening 24 between the rollers of the first assembly 12. Strands 26 are twisted together over core 17, which may be solid or compacted, as they enter the gathering die with core 17 by virtue of the rotation of a frame (not shown) supplying the plurality of strands from a like plurality of spools supported on the frame. Because of the rotation of the frame and the twisting of the strands, the cable 16 leaving the gathering die and entering the rollers of assembly 12 acquires a torque that causes the cable to rotate about its longitudinal axis as it proceeds through apparatus 10. Because of this rotation, the rollers of the invention are relatively adjustable about the axes of openings 24, which are aligned to receive the cable, and relatively adjustable longitudinally so that the roller openings are properly located along the pass line of the cable. These adjustments can be provided by any suitable means, the structure depicted in FIGS. 1 and 2 being one example of such means.

As seen in FIG. 1, the first assembly 12 is fixed while the second and third assemblies 14 and 18 are supported on two stand structures 30 and 32 that are longitudinally movable relative to each other and to the roller assembly 13. Stand structures 30 and 32, represented in FIG. 2 by one of the two stands, are mounted on and between two laterally spaced beam or foundation structures 34. In FIG. 1 only one of these structures is visible. The contacting surfaces, labeled 36 in FIG. 2, of the stands and beams are such that the stands are slideable on the beams in the process of properly locating roller assemblies 14 and 18 with respect to roller assembly 12 and to each other.

Figure 2:
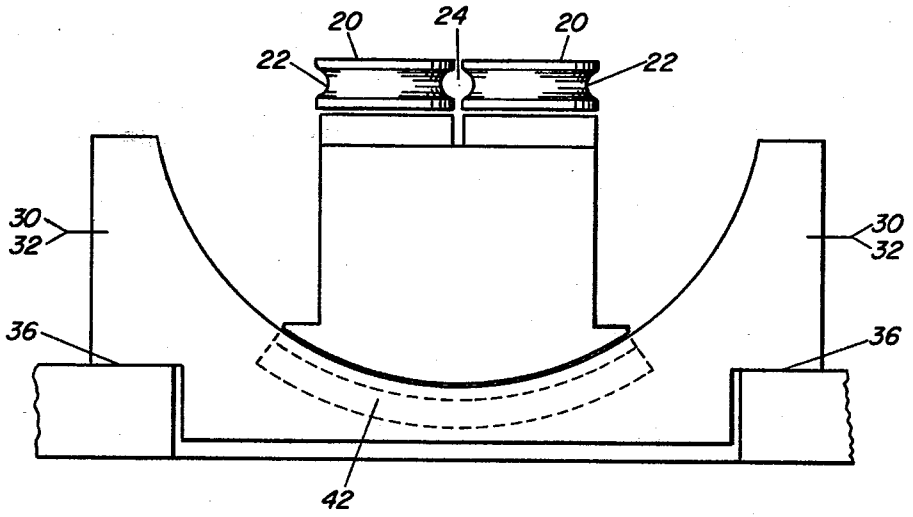
FIG. 2 is a partial end elevation view of an adjustable stand of the invention.

With continuing reference to FIGS. 1 and 2, it will be seen that stands 30 and 32, though only one stand is shown in FIG. 2, each includes a center structure 38 rotatable within the main stand structure (30 or 32) in a manner that angularly orients the rollers 20 of the second set, with respect to the orientation and plane of the first and third roller sets, about the pass line of apparatus 10. As seen in FIG. 1, this structure may take on the form of an inverted T-shaped tongue 42 located in a corresponding curved slot or groove 40 provided in the lower portion of each of the stand structures 30 and 32. The contacting surfaces of the stand and tongue structures are machined and lubricated to allow ease of rotation of the tongue in the slot. A set bolt 44 is shown threaded into and through a lower portion of each stand structure and at a location to engage the edge of tongue 42 to secure structure 38 in the angular displacement chosen for roller assemblies 14 and 18 after they have been properly angularly rotated with respect to the rollers of assembly 12. As indicated earlier, the torque incurred in cable 16, as it enters gathering die 28 and travels through rollers 20 in the compacting process, causes the cable to rotate about its longitudinal axis. For this reason, the second and third assemblies must be oriented to effect proper compacting of the cable after it leaves the first assembly 12. Hence, the locations of stands 30 and 32 along the length of beams 34 and the angular orientation of the rollers 20 of assemblies 14 and 18 are such that they will be properly positioned to track the rotation of the cable as it travels through the rollers of apparatus 10.

Figure 3:
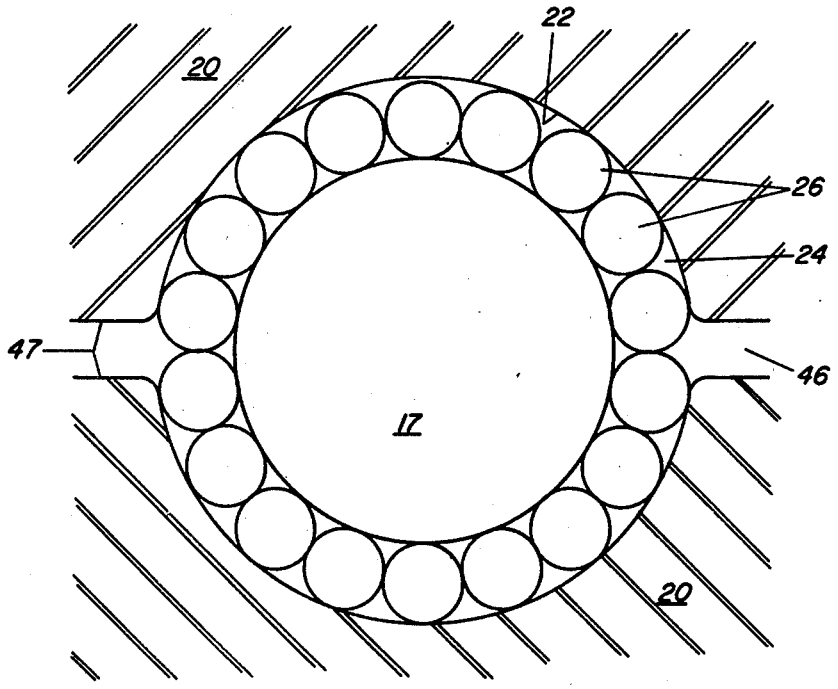
FIG. 3 is a partial cross-sectional view of the first set of rollers of the apparatus in an open position.

FIG. 3 shows, in partial cross-section, the opposed rollers 20 of the first assembly 12. The rollers are in an "open" position, as indicated by horizontal spaces 46 between opposed edges 47 of the rollers. Strands 26 enter into the opening 24 (of 12) from gathering die 28 (FIG. 1) and are wrapped on a solid or compacted wire core 17 by the above-mentioned rotating frame to form the outer layer of circular strands depicted in FIG. 3. The cable itself is pulled through the die by a capstan (not shown) located downstream from the rollers of apparatus 10.

With the rollers of 12 open, as shown in FIG. 3, the outer layer of strands 26 makes minimal contact with the curved surfaces 22 of the rollers. The opening of the rollers in FIG. 3 is such that the radius and diameter of the opening are substantially constant, i.e., the opening is a circle.

Figure 4:
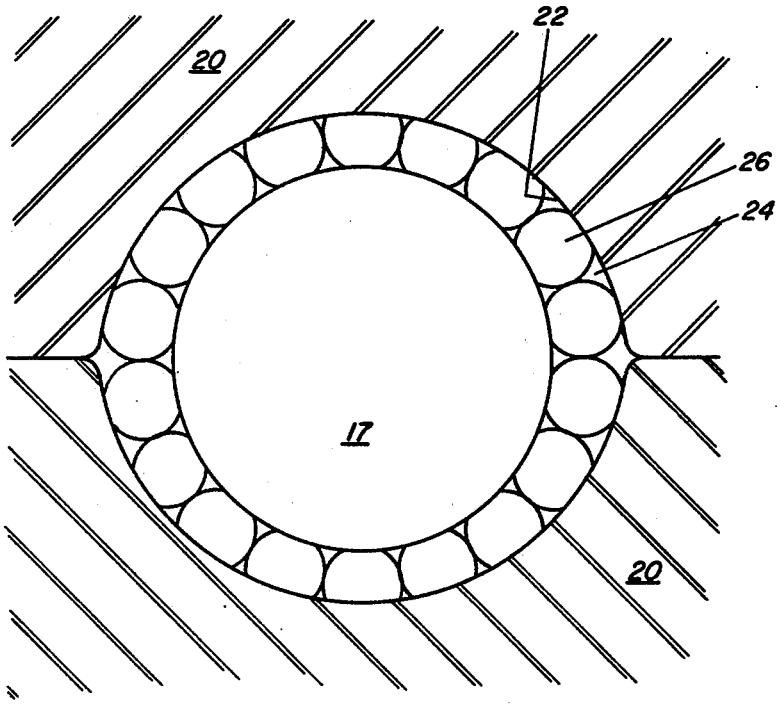
FIG. 4 is the view of FIG. 3 except that the rollers are completely closed.

FIG. 4 of the drawings shows the rollers of 12 fully closed on the cable 16 and on outer strands 26. It will now be noted that the opening has a major axis (in a horizontal plane) crosswise the opening, and perpendicular to a minor axis, in a vertical plane crosswise the opening. A radius R in FIG. 3 is now shifted from the center of the opening by an amount $\Delta d$, as shown in FIG. 4. This "flattens" somewhat the opening such that the helical strands 26, as they are pulled through the opening, and which rotate the rollers 20 about the axis of their bearings, are compacted in the manner suggested in FIG. 4, i.e., the outer strands are flattened in an increasing manner in approaching the vicinity of the minor axis, the amount of flattening becoming less in approaching the sides of the opening along the major axis. At the major axis little or no compacting or flattening of the strands takes place, as seen in FIG. 4.

The flattening that is effected in the vicinity of and along the minor axis takes place against the solid or compacted core 17 which, because of its solidity or compactness, does not change substantially in diameter in the compacting process. Hence, the shape of the outer strands 26 also tends to flatten against the core such that opposed sides of the strands will have flattened surfaces after being compacted in the opening of rollers 12.

The outer layer of strands 26 of cable 16 thus leave the rollers of 12 substantially in the manner depicted in FIG. 4, with the strands in the vicinity of the minor axis of the opening having undergone more compacting than those in the vicinity of the major axis.

As explained earlier, the cable rotates about its longitudinal axis as it proceeds through the rollers of the invention. Hence, the fully compacted, partly compacted and uncompacted strands 26 change position as they progress through the rollers, such that at a particular location downstream from assembly 12 they will have moved 360°. The distance between this location and assembly 12 is equal to the length of the lay of the outer strands. For this reason, the second set of compacting rollers 14 of the invention is rotated up to about 90° relative to 12 as seen in FIG. 1, at a distance from 12 equal to ¼ of the lay length of the strands. The opening of rollers 14, however, is essentially a perfect circle, except for a small relief area 48 provided at the edges of concave surfaces 22 of the rollers when the two surfaces are brought together to form the opening.

Figure 5:
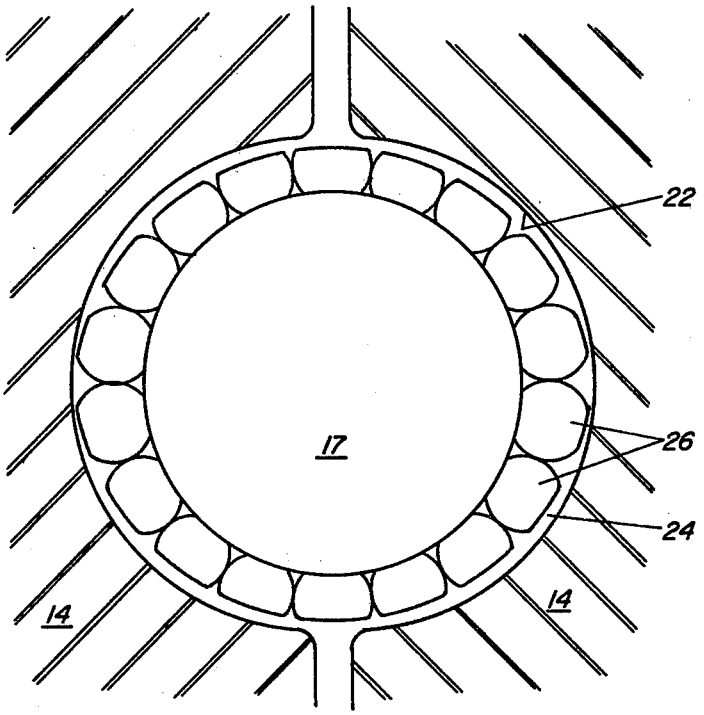
FIG. 5 is a partial cross-sectional view of a second set of rollers of the invention in an open position.
Figure 6:
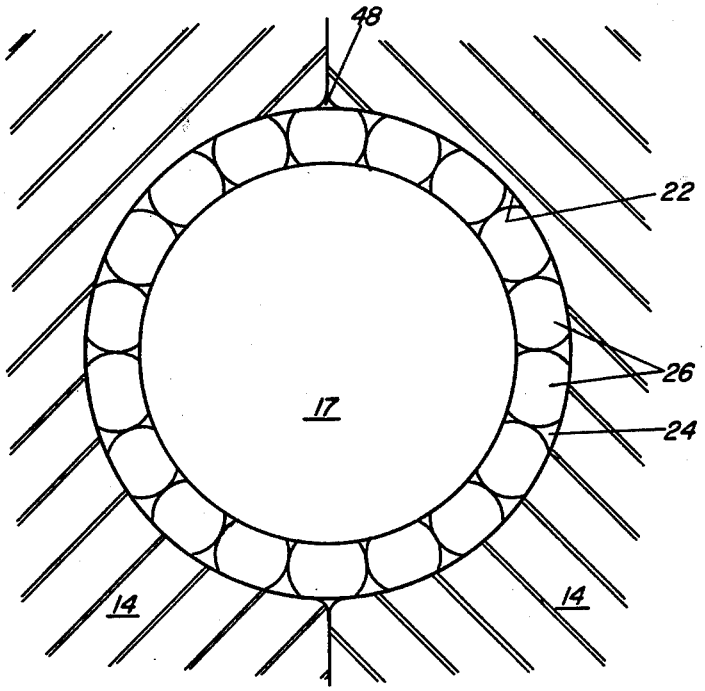
FIG. 6 is the view of FIG. 5, except that the rollers are fully closed.

In FIG. 5, rollers 14 are shown open to the extent that the cross-section of the second opening is slightly elongated or flattened to show the extent to which the partly compacted cable issuing from 12 substantially fills the opening of 14. When the rollers are closed, as shown in FIG. 6, the rollers form a circular opening and a parting line generally perpendicular to the parting of the rollers of 12. The surfaces 22 of the second opening are effective to receive and complete the compacting of the uncompacted and partly compacted strands leaving rollers 12, and thereby present to the rollers of 18 a cable having properly compacted outer strands. Further, by being rotated up to an angular position of about 90° from the rollers of 12, the surfaces 22 of the rollers of 14 engage the major dimension of 16 issuing from 12 to squeeze the dimension so that the cross-section of the cable is rounded in 14.

By compacting outer strands on a core material of a cable in the manner just described, a stress pattern is established in the cross-section of the cable that is symmetrical and generally uniform. As indicated earlier, such a stress pattern removes the tendency of the cable to seek a uniform stress pattern by relative movement of the strands of the cable and birdcaging when the cable is subject to a heating process. Heating a cable to a stress relieving temperature, such as during insulating, activates the desire of the wires to return to a uniform stressed position. As can be appreciated, when a cable is compacted and sized to a certain cross-sectional tolerance and configuration, any significant movement of the strands after the compacting process removes the cable from the tolerance demanded by the industry and provides an opportunity for the insulation to fall between the strands and become defective. With the compacting effected by the present invention, the cable has no memory of a prior uniform stress pattern, since an essentially uniform stress pattern is formed when the cable leaves the rollers of 14.

From the rollers of assembly 14, the compacted cable 16 is pulled through the rollers of assembly 18, the rollers of 18 being effective to further round and size the cable. The position of rollers 18 relative to those of 14 are rotated about 90° so that any ovality of the cable leaving 14 is removed, as the rollers receive the cable along the major axis, if any, of the cross-section of the cable. In this manner, the circular configuration and chosen size (diameter) of the cable are insured for both the manufacturer of the cable and the customer.

If further insurance of roundness and diameter size are desired, for example, with high tolerance cables, an additional set of rollers or a fixed die, such as 50, may be included in the line of apparatus 10, at a location after assembly 18, to further engage and bring the cable to the proper tolerance if such a tolerance is not obtained in 18.

While the invention has been described in terms of preferred embodiments, the claims appended hereto are intended to encompass all embodiments which fall within the spirit of the invention.

What is claimed is:

1. Apparatus for making compacted, helically stranded cable having a generally circular configuration in cross-section, the cable tending to rotate about its axis during the compacting process, the apparatus comprising:

a first set of rollers having peripheral concave surfaces providing a generally circular opening when the concave surfaces are disposed together, the contour of the concave surfaces being such that the opening is provided with a major and a minor axis perpendicular to each other across the cross-section of the opening, the concave surfaces of the rollers being effective to compact at least a portion of outside strands of cable passing through the opening but in varying degrees such that in proceeding peripherally from the minor axis to the major axis the compaction effected decreases from a maximum to a minimum amount, and a second set of rollers located downstream from the first set of rollers and having peripheral concave surfaces providing a second, generally circular opening in line with the first opening when the surfaces are placed together, and a relief along an axis across the opening that is located in the approximate plane of the minor axis of the first opening, the location of the second opening and its axis of relief downstream from the first opening being such that the outside strands of cable leaving the first opening in the vicinity of the minor axis thereof will enter adjacent the axis of relief in the second opening, the second set of rollers being effective to complete the compacting of the outer strands in a manner that provides a circular cable having a residual stress pattern that is substantially uniform throughout the cross-section of the cable.

2. The apparatus of claim 1 including means permitting relative movement of the first and second sets of rollers in a rotational manner about the axis of the openings and in a longitudinal manner between the two sets of rollers.

* * * * *